United States Patent [19]

Matsumura

[11] 4,165,962

[45] Aug. 28, 1979

[54] SAFETY DEVICE OF THE FRICTION RATCHET TYPE OPERABLE ON EXTINCTION OF GAS FLAME

[76] Inventor: Shoji Matsumura, 206 B41 5-5 Furuedai, Suita City, Osaka, Japan

[21] Appl. No.: 852,436

[22] Filed: Nov. 17, 1977

[51] Int. Cl.[2] ..... F23H 5/00

[52] U.S. Cl. ..... 431/83

[58] Field of Search ..... 431/81, 83, 84, 77

[56] References Cited

U.S. PATENT DOCUMENTS

| | | | |
|---|---|---|---|
| 320,694 | 6/1885 | Rice et al. | 431/83 |
| 1,984,444 | 12/1934 | Thornhill | 431/83 |

FOREIGN PATENT DOCUMENTS

| | | | |
|---|---|---|---|
| 364522 | 1/1932 | United Kingdom | 431/8 |

*Primary Examiner*—Edward G. Favors
*Attorney, Agent, or Firm*—Darby & Darby

[57] ABSTRACT

A device for comprising a support bar and a holding bar formed with holes respectively extending therethrough and arranged coaxially in alignment with each other and a valve operating rod slidably extending through the holes and supported by the bars. When a heater wire is elongated by a gas flame, an auxiliary spring acts to incline the holding bar, causing the holding bar to hold the valve operating rod by the principle of friction ratchet, with the rod maintaining a stop valve in its open position. On contraction of the heater wire due to extinction of the gas flame, the holding bar returns to its original position, releasing the valve operating rod, which in turn closes the stop valve under the action of a spring.

24 Claims, 15 Drawing Figures

SAFETY DEVICE OF THE FRICTION RATCHET TYPE OPERABLE ON EXTINCTION OF GAS FLAME

The present invention relates to safety devices for gas combustion apparatus, and more particularly to safety devices operable on extinction of the flame of the main burner or pilot burner of gas combustion apparatus to stop leak of unburned gas instantaneously or as quickly as possible.

Presently, town gas and propane gas are widely used in factories as well as for household uses because of their great convenience. This entails serious problems of gas poisoning and gas explosion accidents due to leaks of unburned gas. Such hazardous leaks of unburned gas may sometimes be caused by malfunction of the apparatus and connectors but more frequently by the extinction of the flame of the main burner or pilot burner during use or by inadvertently leaving the gas line open without noticing that the gas burner has not been ignited. Especially, gas leakage is a serious problem in the case of ranges with which an overflow of boiled liquid is likely to take place, in the case of water boilers and refrigerators in which the pilot burner is kept lighted for a prolonged period of time, or in the case of heating apparatus which are accessible to infants.

Various devices of the bimetal, bellows or thermocouple type have heretofore been provided for preventing the leakage of unburned gas due to the extinction of flame. These devices have found wide use especially as safety devices for pilot burners operable in the event of extinction of the flame.

Devices of the bimetal type in which a valve is operated utilizing the displacement of a bimetal due to its thermal deformation are inexpensive but are not highly responsive to heat and are susceptible to fatigue during repeated use. In fact, devices of this type are very slow to respond to heat because the bimetal, which is low melting (at 300° to 400° C.), is adapted to be heated indirectly by the gas flame (700° to 800° C.) through a protective plate or wire without being exposed directly to the flame. Thus they are presently used only for special applications as in refrigerators.

Devices of the bellows type include a bellows enclosing a fluid which, when heated, expands, giving pressure to open a valve. Devices of this type also have slow responsiveness and are more expensive than the bimetal type and therefore almost out of use at present.

Devices of the thermocouple type incorporate a thermocouple which, when heated, produces a thermoelectric current, energizing an electromagnet which in turn attracts an iron piece on the stem of a gas stop valve to open the valve. They are more responsive than those utilizing the displacement caused by thermal expansion, achieve a corresponding reduction in the leakage of unburned gas and ensure higher safety.

When igniting the burner, however, devices of this type require 10 to 30 seconds to cause the stop valve to maintain its open position owing to a delay involved in the generation of electric current. Additionally 50 to 60 seconds elapse after the extinction of the flame before the stop valve returns to its closed position on interruption of flow of current to stop the leak. The device is of expensive and complex construction because of the electromagnetic value and of the necessity of finishing the contact faces of the electromagnetic valve and the iron piece with high precision. Although the above-mentioned time can be reduced to 2 to several seconds by the use of an amplifier, the device then becomes prohibitively costly and usable only for greatly limited applications. Moreover, electromagnetic valves have low resistance to vibration and impact, are prone to damage at the junction of its constituent conductors when exposed to high temperatures for a prolonged period of time and must accordingly be replaced from time to time. Like devices of the bimetal or bellows type, it is difficult to use thermocouple type devices for the main burner. Because the device takes some time for ignition and is expensive, it has the fatal drawback of being unsuited for use in inexpensive ranges which are widely used and with which gas leakage is frequently experienced. Thus it is desirable to provide a new safety device.

In view of the foregoing problems, I have conducted intensive research and found that the principle of the friction ratchet is useful in holding a gas stop valve in its open position. Consequently I have developed a safety device operable on extinction of a gas flame which comprises the combination of a friction ratchet and an inexpensive heater wire having high heat resistance and which is much superior to conventional safety devices in every respect of responsiveness, cost and durability.

The principle and embodiments of this invention will be described below in greater detail with reference to the accompanying drawings, in which.

Figure 5:
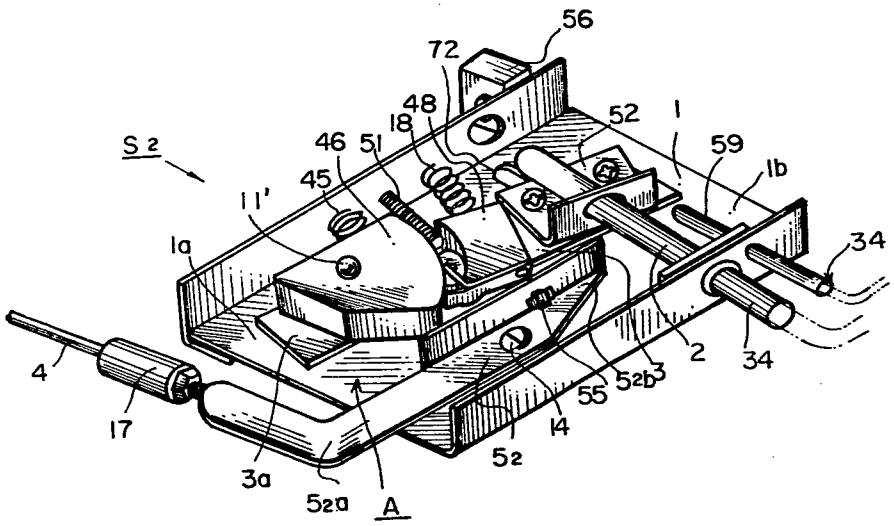
FIG. 5 (*a*) is a perspective view showing another embodiment of this invention.
Figure 7:
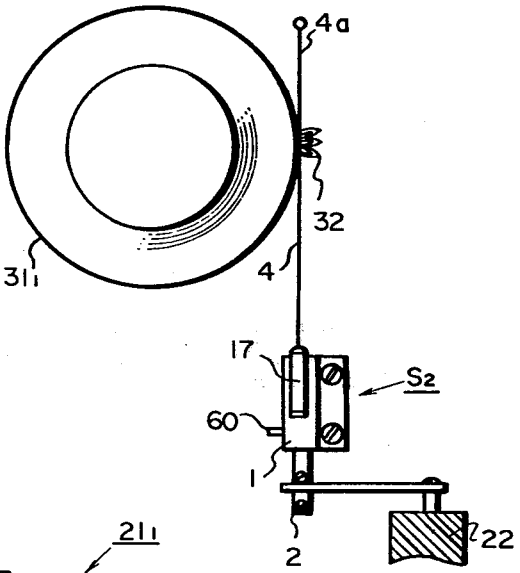
Figure 7:
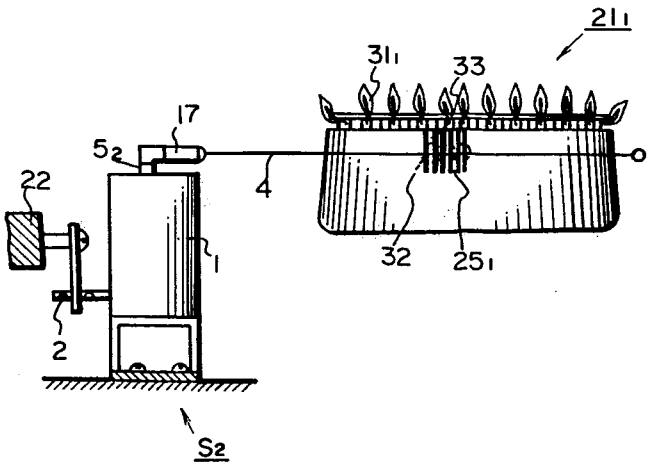
Figure 6:
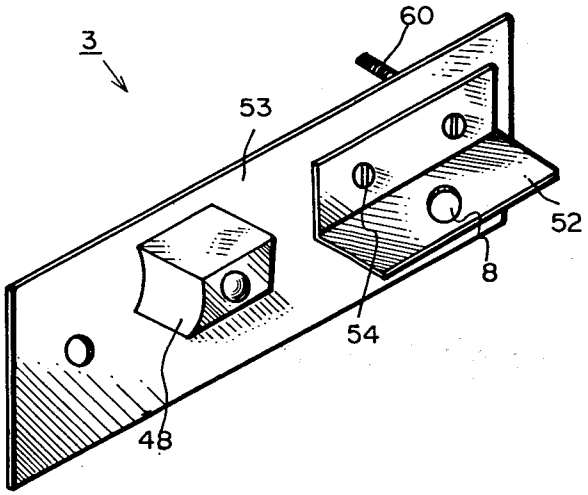
Figure 10:
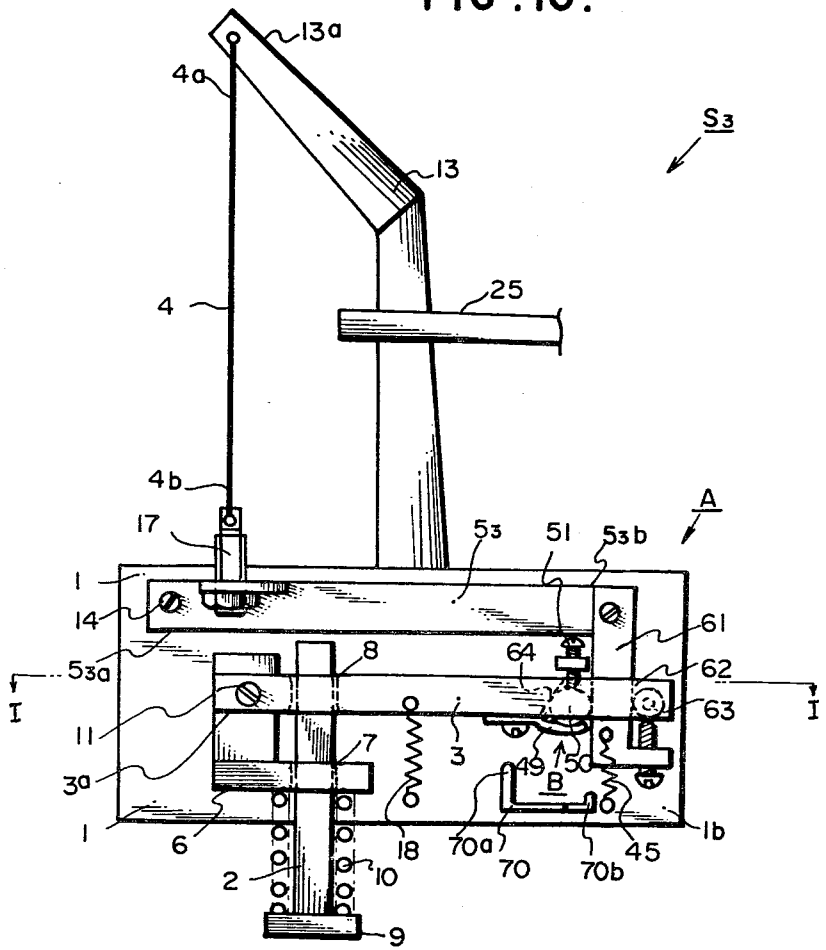
Figure 8:
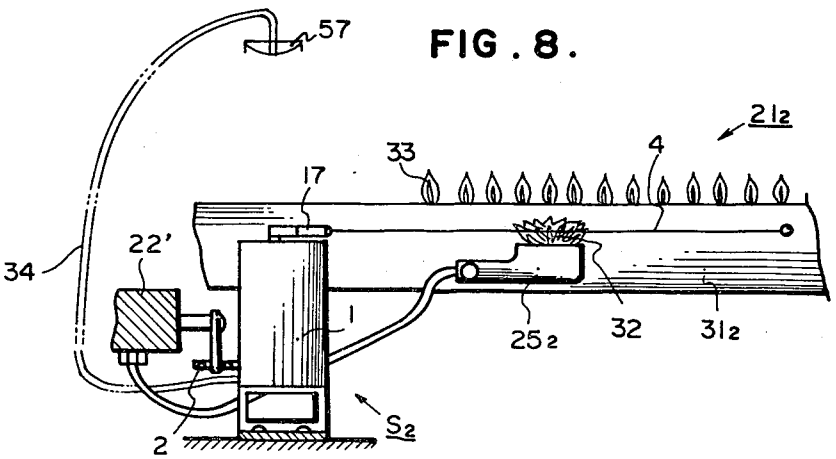
Figure 9:
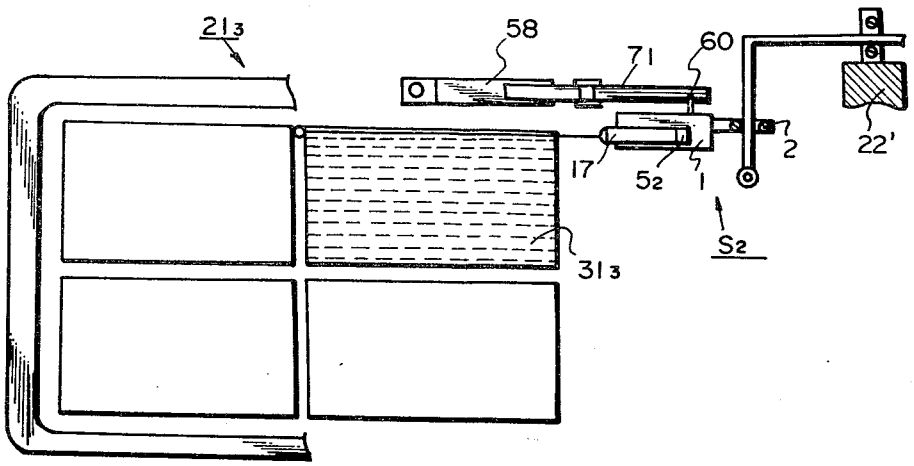
Figure 11:
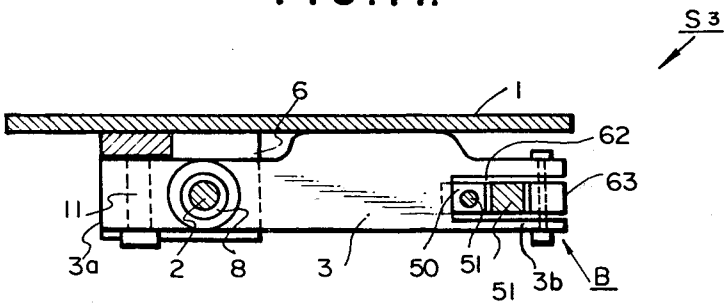

FIGS. 5 (*b*) and (*c*) are views illustrating the operation of the embodiment;

FIG. 6 is a perspective view showing a holding bar;

FIGS. 7 (*a*) and (*b*) are a plan view and a side elevation respectively schematically showing a gas range incorporating the safety device;

FIG. 8 is a schematic side elevation of a water boiler incorporating the safety device;

FIG. 9 is a schematic front view showing a gas heater incorporating the safety device;

FIG. 10 is a plan view showing another embodiment of this invention;

FIG. 11 is a view in section taken along the line I—I in FIG. 10; and

Figure 12:
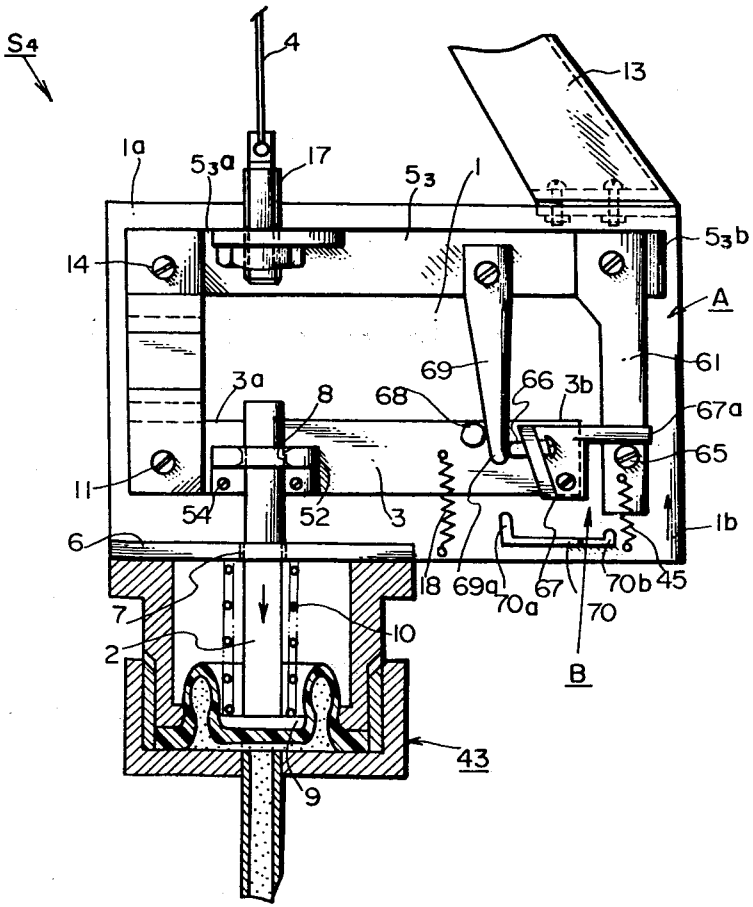

FIG. 12 is a plan view showing another embodiment of this invention.

Figure 1:
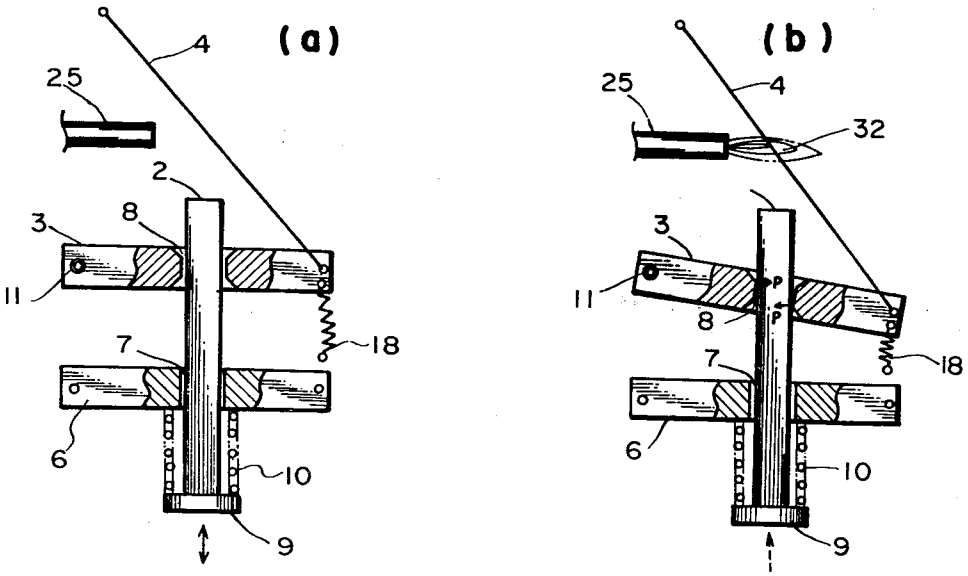
FIG. 1 is a schematic view of a friction ratchet to illustrate its principle embodied in this invention.

With reference to FIG. 1 showing the principle of the operation of this invention, two plates or bars arranged in parallel are formed with holes 7 and 8 aligned with each other and having the same diameter. One of the bars is fixed in position, serving as a support bar 6, while the other bar is pivoted at its one end to serve as a holding bar 3. A valve operating rod 2 having a slightly smaller diameter than the diameter of the holes 7 and 8 slidably extends through the holes 7 and 8 as illustrated in FIG. 1 (*a*). When the holding bar 3 is inclined slightly downward as seen in FIG. 1 (*b*), the periphery defining the hole 8 exerts a shearing force P on the rod 2, which in turn is thereby held to the bar 3 against any downward displacement. This principle is utilized in this invention.

The more the valve operating rod 2 is pulled downward, the greater will be the force P and the more effectively will the rod 2 be held to the bar 3.

The holding rod 3 is inclined by the stretch of a heating wire 4 produced when the wire is heated by the gas flame 32 of a pilot burner 25 in combination with the tension or compression of an auxiliary spring 18. The operating rod 2 is connected to the stem of a stop valve which is usually closed and provided on a gas supply duct. To ignite the burner 25, the valve stem, namely the valve operating rod 2 is pushed upward aginst a spring 10 thereon by some means, for example, by depressing the knob of the stopcock and is held in its raised position by engagement with the holding bar 3. When the flame goes out, the heater wire 4 contracts, bringing the holding bar 3 to its original position in parallel to the support bar 6, whereupon the valve operating rod 2 released from the bar 3 is forced down by the spring 10 to close the stop valve. Thus the friction ratchet mechanism is smoothly operable with its simple construction.

The heater wire is superior in heat resistance to bimetals or thermocouples and is repeatedly usable semipermanently free of breakage or degradation even when exposed directly to the gas flame of a pilot or main burner. The elongation of the wire is delivered, as magnified, to the holding bar 3, so that the mechanism can be actuated in 2 to 3 seconds in response to ignition and in about 2 to 10 odd seconds in response to extinction. Thus the safety mechanism of this invention is superior to the conventional devices in every respect.

For service at temperatures of up to 1150° C., illustrative examples of useful heater wires are inexpensive wires of heat-resistant 17Cr-66Ni and like steel alloys which have been heat-treated at 1000° C. for about 10 minutes. Other metal wires are also useful insofar as they are resistant to high temperatures of more than about 1000° C. and have resistance to corrosion and gas at high temperatures.

Since the combustion temperature of the outer portion of the household gas flame is 700° to 800° C., the heater wire 4 remains free of melting even when exposed directly to the flame. When the heat-resistant wire of 17Cr-66Ni steel alloy wire is heated at 700° C., the stress producing 1% creep in 100,000 hours is 2 $kg/mm^2$. The wire usually has a diameter of about 1.2 mm. The wire is serviceable almost free of any permanent elongation for the reason that the only force to be exerted on the wire will be the tension (several tens to several hundreds of grams) given by some springs.

Figure 2:
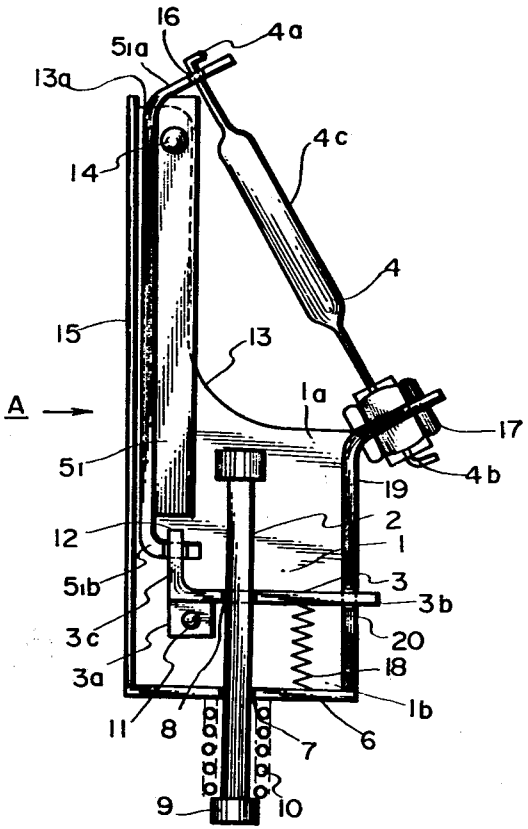
FIG. 2 is a plan view showing a safety device according to this invention.

FIG. 2 shows a safety device $S_1$ of extremely simple structure utilizing the principle described above. The device $S_1$ comprises a main body 1, a valve operating rod 2, a bar 3 for holding the operating rod 2, and holding bar turning means A consisting mainly of a lever $5_1$ for turning the holding bar by the contraction or expansion of a heater wire 4.

The valve operating rod 2 slidingly extends through coaxial holes 7 and 8 formed in a support bar 6 and the holding bar 3 respectively and is thereby supported. The rod 2 is retained in its downwardly projected position by a spring 10 provided thereon between the support bar 6 and the lower enlarged end 9 of the rod 2.

The holding bar 3 is pivoted at its one end 3*a* to the main body 1 by a pin 11 and is formed at the pivoted end 3*a* with a projection 3*c* fitting in and supported by a cutout 12 in the lower bent end $5_1b$ of the lever $5_1$.

The lever $5_1$ is positioned at a right angle with the holding bar 3 and pivoted by a pin 14 to the forward end of an arm 13 projecting from the upper portion 1*a* of the main body. The lever $5_1$ is prevented from turning outward by a side frame 15 on the main body. The lever $5_1$ has an upper bent end $5_1a$ formed with a hole 16 through which the upper end 4*a* of the heater wire 4 is passed and the end 4*a* is bent against disengagement. The heater wire 4 has a lower end 4*b* extending through a tension adjusting screw 17 secured to the upper end 1*a* of the main body 1 on one side thereof opposite to the arm 13. The lower end 4*b* of the wire 4 is bent in engagement with the screw 17. The intermediate portion 4*c* of the heater wire may be rolled to a flat form to ensure effective heat absorption and dissipation. The tension adjusting screw 17 is useful in correcting a permanent strain, if any, on the heater wire 4 or replacing the heater wire 4. The upper end 4*a* of the heater wire must be rendered free in the direction of elongation to accommodate the thermal elongation of the wire greater than is required.

The holding bar 3 is always so biased as to incline about the pin 11 by an auxiliary spring 18 included in the holding bar turning means A. However, since the projection 3*c* on the holding bar 3*c* is in fitting engagement with the cutout 12 in the lever lower end $5_1b$, the axis of the hole 8 is kept vertical at all times.

When the heater wire 4 expands on heating, the lever $5_1$ is made turnable within the corresponding range, with the result that the lever is drawn by the spring 18 through the holding bar 3, permitting the inclination of the bar 3, therefore of the axis of the hole 8. The other end 3*b* of the holding bar 3 is limited in the range of its movement by a cutout portion 20 of a side frame 19 of the main body 1, the cutout portion 20 thus serving as a stopper. The spring 18 may be so provided as to pull the holding bar 3 downward or to depress the bar 3 from above.

Figure 3:
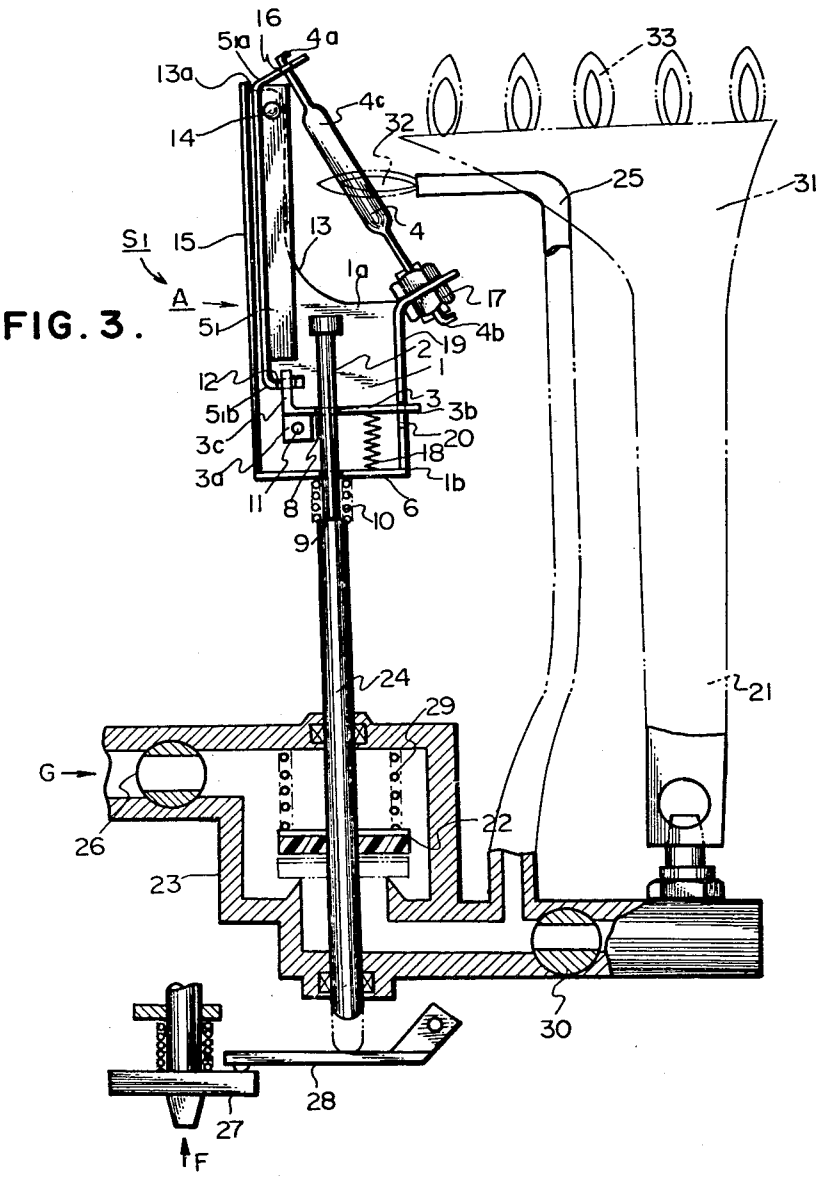
FIG. 3 is a schematic view showing the safety device as incorporated in a gas combustion device.
Figure 5:
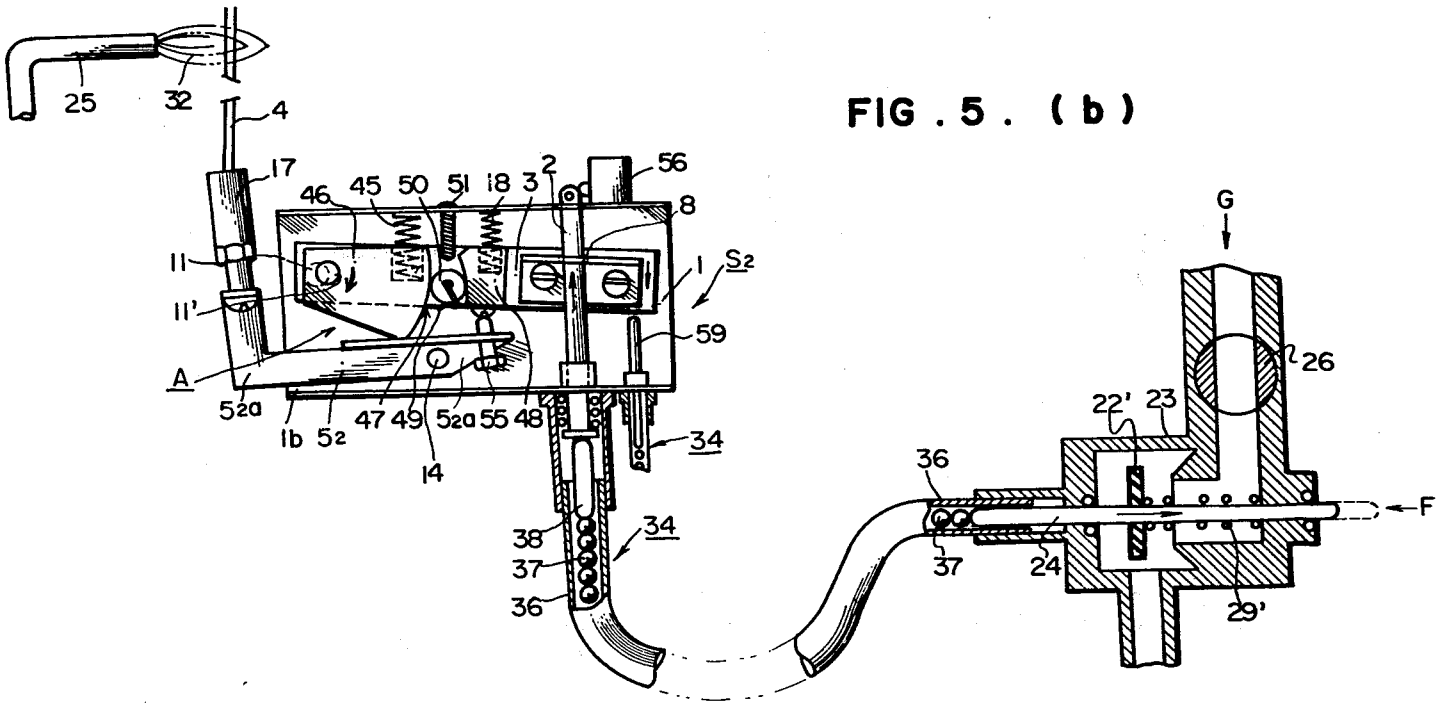
Figure 5:
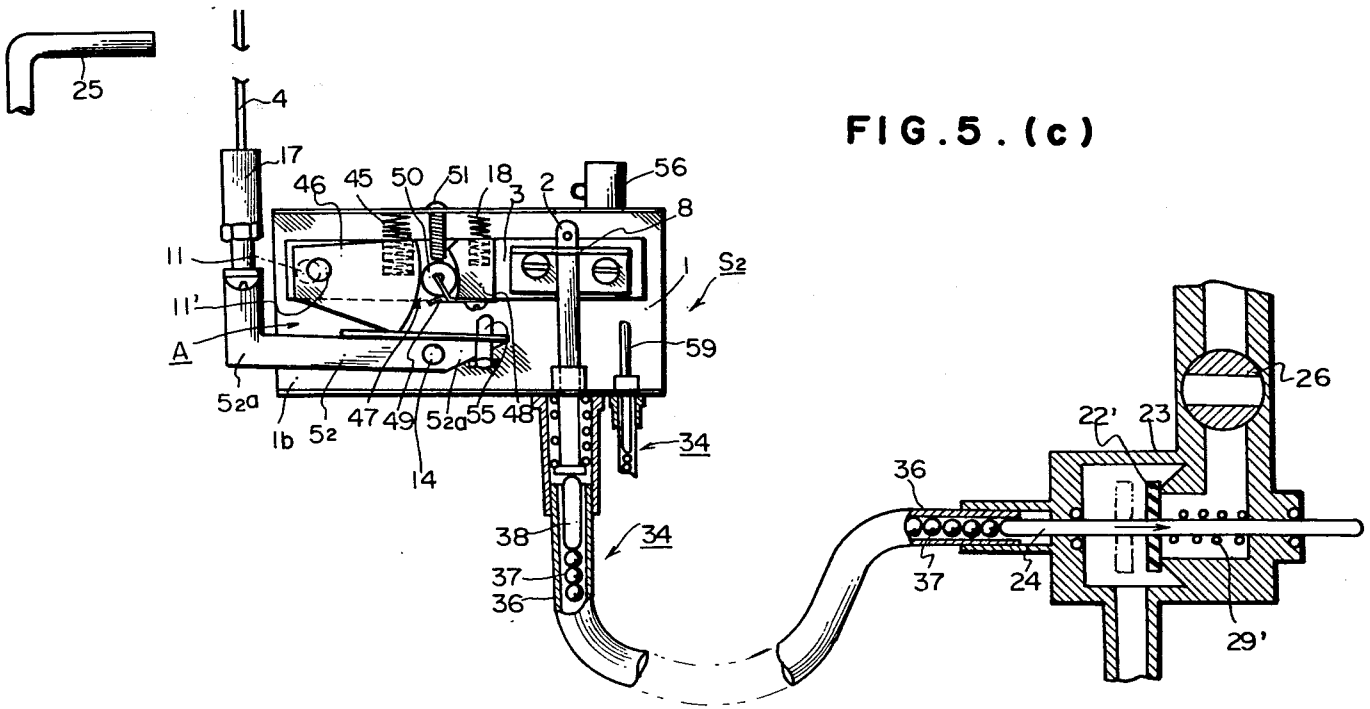

FIG. 3 shows the safety device $S_1$ as incorporated in a gas combustion apparatus 21. The safety device of this invention, like that of the thermocouple type, must function to keep the valve in its open position during combustion and to close the valve immediately after the extinction of the flame, so that a stop valve 22 of the normally closed type is incorporated in a gas supply duct 23 for the gas combustion apparatus 21, with the valve operating rod 2 connected directly to the stem 24 of the stop valve 22.

For the ignition of the pilot burner 25 of the gas combustion apparatus 21, the main stopcock 26 on the apparatus has a knob 27 of the pushing type which is operated to cause a lever 28 to depress the stem 24 of the stop valve 22 in the direction of the arrow F against the spring 29 to open the valve, whereby gas G is allowed to flow into the apparatus as indicated by the arrow. The lever 28 also pushes up the valve operating rod 2 against the spring 10, the rod 2 being freely movable through the holes 7 and 8. Next, the pilot burner 25 is ignited by some procedure, for example, by turning the knob 27 on the main stopcock to actuate a piezoelectric igniter (not shown).

Two to three seconds after the ignition, the heater wire 4 extends, causing the auxiliary spring 18 to incline the holding bar 3, therefore the axis of the hole 8, with the result that the holding bar 3 holds the valve operating rod 2 in its raised position. Accordingly even if the knob 27 and the lever 28 are then returned, the valve stem 24 connected to the valve operating rod 2 will not descend, holding the valve 22 in its open position.

The heater wire 4, when made of heat-resistant 17Cr-66Ni steel alloy, expands about 1% on heating to 700° C. The expansion is magnified 10 to 15 times by the lever $5_1$ and delivered to the holding bar 3. Since the difference in diameter between the hole 8 and the valve operating rod 2 is very small, enabling the bar 2 to fully hold the rod 2 when the axis of the hole inclines even if slightly, the heater wire 4 extends to a required length when heated for a short period of time. According to the construction described, the heater wire 4 can give the desired turn to the holding bar 3 if it is at least 40 to 50 mm in length.

Subsequently a stopcock 30 for the main burner 31 is opened to ignite the burner 31. While the heater wire 4 is being exposed to the gas flame 32 or 33 of the pilot burner 25 or the main burner 31, the heater wire 4 continues to expand up to about 1% if the flame temperature is about 700° C. However, the holding bar 3, which is restrained by the valve operating rod 2, will not be inclined more than a certain angle. To accommodate the excess expansion of the wire, therefore, it is necessary to make the hole 16 in the upper bent end $5_1a$ of the lever 5 or the cutout 12 in the lower end $5_1b$ larger than the corresponding fitting part for a loose fit. Alternatively the heater wire 4 may be made slack.

If the main stopcock 26 is closed or the gas flame 32 or 33 is extinguished for one cause or another, the heater wire 4 contracts, returning the lever $5_1$ to its original position against the action of the auxiliary spring 18, whereupon the valve operating rod 2 released from the holding bar 3 is forced downward to its projected position by the spring 10 or the spring 29 on the stop valve to close the valve. This takes about not more than about 10 seconds.

Figure 4:
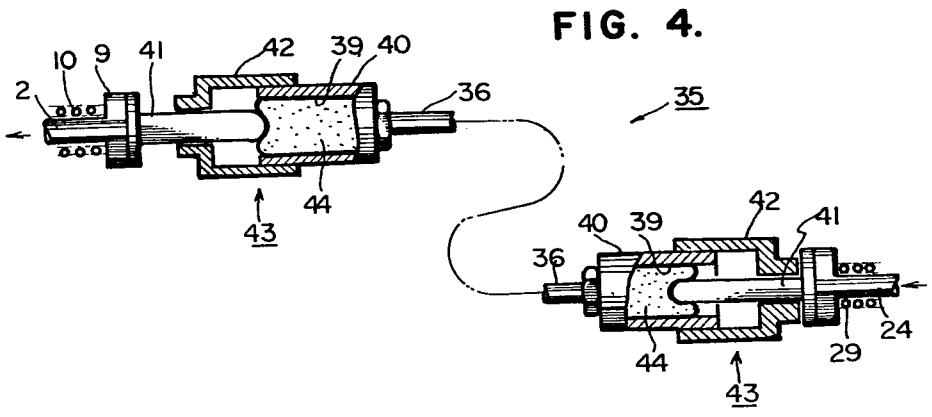
FIG. 4 is a side elevation in vertical section showing a hydraulic coupling means.

If the knob 27 is positioned close to the burners 25 and 31, the valve operating rod 2 and the stem 24 of the stop valve 22 may be made integral, in which case either one of the springs 10 and 29 can be omitted. However, when the knob is remote from the burners as in a bath water boiler, or in the case where the safety device is provided as an independent unit in the gas combustion apparatus 21, there is the necessity of connecting the valve operating rod 2 to the valve stem 24 by some means such as lever or release. Also useful for this purpose are the ball coupling means 34 shown in FIG. 5 (*b*), 5 (*c*) and hydraulic coupling means 35 shown in FIG. 4. The ball coupling means 34 comprises a flexible metal pipe 36 made of copper, aluminum or the like and balls 37 such as metal or glass balls filled in the pipe 36 and having a diameter slightly smaller than the inside diameter of the pipe 36. Further between the enlarged lower end of the rod 2 and the balls 37 there is disposed a weight 38, such that when one of the rod 9 and the valve stem 24 is pushed, the balls 37 within the metal pipe 36 move to project the other.

The hydraulic coupling means 35 comprises two pieces 43 each including a cylinder 40 and a cap 42 fitting over the cylinder and slidably supporting a movable rod 41 inserted thereinto through its top and a flexible metal pipe 36 interconnecting the two pieces 43. A rubber packing 39 U-shaped in section is fixedly fitted in the cap 42. Silicone oil 44 is enclosed within the rubber packings 39 and the metal pipe 36. Couplings 34 and 35 are very convenient for connecting the valve operating rod 2 and the valve stem 24 and smoothly operable, since the metal pipe 36 has the desired length and is flexible to the desired shape.

In the case where a release or the ball coupling means 34 or hydraulic coupling means 35 is used for the connection between the valve operating rod 2 and the valve stem 24, the valve operating rod 2 held by the holding bar 3 in its raised position is unable to hold the valve stem 24 in its raised position. Accordingly there is of using a stop valve 22′ of the normally open type as the stop valve and a spring 29′ for raising the valve stem 24 which spring is weaker than the spring 10.

FIG. 5 (*a*) shows a safety device $S_2$ according to another embodiment of the invention which operates instantaneously free of the influence of the extension or permanent elongation of the heater wire 4 caused by heating and which releases the valve operating rod 2 to close the stop valve 22 on the break of the heater wire 4. The holder bar turning means A of this device $S_2$ comprises a sector lever 46 pivoted by a pin 11 or by a pin 11′ positioned close to the pivoted portion 3*a* of the holding bar 3 and biased downward by a spring 45 for preventing the slackening of the heater wire, a projection 48 secured to the holding bar 3 for forming an arcuate wedge-shaped space 47 between the sector lever 46 and the projection, an auxiliary spring 18 for biasing the holding bar 3 toward an inclined position at all times, a ball, roller or like rotatable member 50 to be forced into the arcuate wedge-shaped space 47 by a support spring 49 attached to the under face of the projection 48, a stopper 51 for preventing the holding bar 3 from turning upward from the specified position, and a lever $5_2$ having the lower end 4*b* of the heater wire attached to its one end $5_2a$ and pivoted to the lower portion 1*b* of the main body in parallel to the holding bar 3, the lever $5_2$ being in contact with the sector lever 46 from below.

For the use of the gas combustion device 21 the valve stem 24 of the stop valve 22′ is depressed in the direction of the arrow F as seen in FIG. 5 (*b*), raising the valve operating rod 2 to allow gas G to flow into the apparatus. The pilot burner 25 is ignited to elongate the heater wire 4 by heating the wire 4 with its gas flame 32, consequently inclining the lever $5_2$. The sector lever 46 in contact with the lever $5_2$ is turned by the force of the spring 45, turning the holding bar 3 which is connected to the sector lever 46 through the rotatable member 50. As a result, the valve operating rod 2 extending through a hole 8 in the holding bar 3 is firmly held by the bar 3 with a shearing force to maintain the valve in its open position.

During the combustion, the heater wire 4 continues to extend to a certain length, permitting the sector lever 46 to turn. However, the holding bar 3 will not be inclinded more than a certain angle by being restrained by the valve operating rod 2. Since the sector lever 46 at this time moves in the direction in which the width of the space 47 increases, the rotatable member 50 is freed to release the lever 46 and the projection 48 from each other, causing the spring 45 to turn the sector lever 46 downward in contact with the lever $5_2$.

When the pilot burner 25 in this state is extinguished, the heater wire 4 starts to contract while releasing the heat as shown in FIG. 5 (*c*). This takes about 2 to several seconds. Simultaneously with the contraction of the heater wire 4, the lever $5_2$ pushes up the sector lever 46 when returning to its original position. At this time, the sector lever 46 moves in the direction in which the width of the arcuate wedge-shaped space 47 decreases, bringing the rotatable member 50 into engagement with the lever 46 and the projection 48. Consequently, the holding bar 3 is brought to its original position, releasing the valve operating rod 2 to close the valve.

With the safety device $S_2$ according to the present embodiment, the sector lever 46 and the rotatable member 50 cause the holding bar 3 to hold the valve operating rod 2 immediately on ignition of the pilot burner 25 and to release the rod 2 upon extinction of the flame irrespective of the elongation of the heater wire 4 and the state of the lever $5_2$. This operation involves a time delay of about 2 to 4 seconds.

If the holding bar 3 turns upward too much, it becomes difficult to open the valve. To eliminate such difficulty, the stopper 51 in the form of an adjusting screw is provided on the main body 1 above the rotatable member 50 for depressing the rotatable member 50 moving upward from its specified position to disconnect the sector lever 46 from the projection 48 on the holding bar, causing the auxiliary spring 18 to return the holding bar 3 downward.

When the holding bar 3 comprises a rectangular plate 53 and a member 52 of L-shaped cross section formed with a hole 8 for passing the valve operating rod and secured to the plate 53 by screws 54 as seen in FIG. 6, it becomes convenient to adjust the position of the axis of the hole 8 when making the device. By providing lever $5_2$ with a projection 55 on one end $5_2b$ thereof opposite to the heater wire carrying end $5_2a$, the spring 45 and the sector lever 46, will cause the projection 55 to instantaneously raise the holding bar 3 to its original position and thereby release the valve operating rod 2 if wire 4 should break. Thus, stop valve 22' will be closed to ensure safety. In such a case, the heater wire 4 is very easy to replace, it being needed only to adjust the valve stem 24, namely the valve operating rod 2 for free sliding movement by the tension adjusting screw 17.

A microswitch 56 may be secured to main body 1 above the valve operating rod 2, such that the microswitch 56 is closed when the valve operating rod 2 is raised, namely when the stop valve 22 or 22' is opened so as to operate a ventilating fan (not shown) simultaneously with ignition.

In the case of a water boiler as for a bath, a heater or like apparatus 21 which burns a large quantity of gas, it is critical to prevent overheating of the apparatus or heating of the water tubes in the absence of water. For this purpose, the apparatus may be provided with a bimetal disk 57 or bimetal plate 58 at a side portion thereof so that the deformation of the disk or plate can be delivered through the coupling means 34 or 35 or a lever or release to a pusher rod 59 provided below the holding bar 3 on the main body. In the event of overheating, the holding bar 3 is pushed up to its original position to release the valve operating rod 2 and close the valve. In this case, the holding bar 3 may be provided on its rear side with a projection 60 extending through a slide aperture 71 in the main body 1 to push up the holding bar 3.

FIGS. 7 to 9 schematically show various gas combustion apparatus 21 incorporating the safety device $S_2$ of this invention.

FIGS. 7 (*a*) and (*b*) show a gas range $21_1$ including an annular burner $31_1$. The heater wire 4 extending tangentially of the annular burner $31_1$ has its upper end 4*a* secured to the gas range $21_1$. Thhe burner $31_1$ is formed in a side portion thereof with an aperture $25_1$ for heating the wire 4 with a gas flame 32.

FIG. 8 shows the present device as used for a water boiler $21_2$ as for a bathroom. The heater wire 4 is provided above a pilot burner $25_2$ disposed between main burners $31_2$ arranged in parallel. In the event of overheating, a bimetal disk 57 functions to return the holding bar 3 to its original position through coupling means to close the valve.

FIG. 9 shows the present device as incorporated in a gas heater $21_3$, with the heater wire 4 extending in front of a burner $31_3$. In the event of overheating, a bimetal plate 58 causes a lever 71 to raise a projection 60, returning the holding bar 3 to its original position to close the valve.

FIGS. 10 and 12 show other embodiments including different holding bar turning means A but having substantially the same construction.

The safety devices $S_3$ and $S_4$ are very quick to respond like the foregoing safety device $S_2$. These devices $S_3$ and $S_4$ comprise a lever $5_3$ extending in parallel to the holding bar 3 and pivoted at its one end $5_3a$ to one side of the upper portion 1*a* of the main body 1, and a movable plate 61 pivoted to the other free end $5_3b$ of the lever $5_3$ and biased downward by a spring 45 for preventing the slackening of the heater wire 4, the movable plate 61 being movable by the expansion and contraction of the heater wire 4. The holding bar 3 is provided on its free end 3*b* with means B for slidably holding the movable plate 61 and has an auxiliary spring 18 for biasing the holding bar 3 toward an inclined position at all times. The lower end 4*b* of the heater wire 4 is attached to the lever $5_3$ inwardly of its pivoted portion $5_3a$ by a tension adjusting screw 17. The upper end 4*a* of the heater wire is attached to the forward end 13*a* of an arm 13 extending upward from the main body 1.

The means B for slidably holding the movable plate shown in FIG. 10 comprises a roller 63 and a rotatable member 50 disposed in a wedge-shaped cutout portion 62 of the holding bar 3 and adapted to nip the movable plate 61. The roller 63 is rotatably supported by the cutout portion 62, while the rotatable member 50 is retained by a support spring 49 in its pushed-in position between a tapered portion 64 and the movable plate 61. The means B is provided with a stopper 51 for preventing the holding bar 3 from turning upward from a horizontal position. FIG. 11 is a view in section taken along the line I—I in FIG. 10.

The slidably holding means B shown in FIG. 12 comprises a hook 67 pivoted to the free end 3*b* of the holding bar 3 and having a front end 67*a* supported by a lower projection 65 on the movable plate 61 and projection 66 on its rear end, a projection 68 provided on the holding bar 3 and positioned slightly inwardly of the rear end projection 66 on the hook, and a wedge member 69 pivoted to the lever $5_3$ and positioned inwardly of its free end $5_3b$, the wedge member 69 having a forward end 69*a* positioned between the rear end projection 66 and the projection 68 on the holding bar 3.

Although the means B for holding the movable plate in the embodiments of FIGS. 10 and 12 are positioned at the free end 3*b* of the holding bar 3, the means B may be provided at the center portion of the holding bar, with the valve operating rod 2 positioned at the free end 3*b*. Furthermore, the upper end 4*a* of the heater wire 4 attached to the forward end 13*a* of the arm 13 may alternatively be secured directly to the gas combustion apparatus without employing the arm 13. According to the embodiments of FIGS. 10 and 12, a lever 70 in the form of a shallow channel in side elevation may be pivotally provided below the holding bar 3, such that when the heater wire 4 breaks off, the movable plate 61 causes its lower end to depress one end 70*b* of the lever 70, raising the other end 70*a* of the lever 70 to instantaneously return the holding bar 3 to its original position and thereby release the valve operating rod 2.

With the safety devices according to this invention, the elongation of the gas flame detecting heater wire produced by being heated with a gas flame is magnified by holding bar turning means and then delivered to a holding bar to incline the bar, causing the bar to hold a valve operating rod by the principle of friction ratchet in the open position of a stop valve of the normally closed or open type to the valve stem of which the operating rod is connected, the valve being installed on a gas supply duct for a gas combustion apparatus. Upon extinction of the gas flame, the heater wire contracts, thereby returning the holding bar to its original position and causing the valve operating rod to close the stop valve when released from the holding bar.

Accordingly the present devices are very quick to respond, acting to hold the valve in its open position in 2 to 3 seconds on ignition and to close the valve in about 2 to 10 seconds on extinction of the gas flame, although the time taken varies with the construction of the holding bar turning means. Thus the leak of dangerous unburned gas can be prevented. The devices are simple to use and well-suited for gas combustion apparatus such as gas ranges which are frequently used.

The devices of this invention are extremely simple in construction and are therefore inexpensive, tough and resistant to impact. The heater wire made of highly heat resistant steel alloy is serviceable free of any trouble semipermanently even when exposed directly to the flame of the main burner as in gas ranges and heaters or when quenched with an overflow of boiling liquid. Even if permanent strain takes place in the heater wire, the strain can be easily compensated for automatically or by moving an adjusting screw. Because of these outstanding novel features, the present devices are superior to conventional safety devices.

In fact, the present devices are useful in various applications; they can be incorporated into any gas combustion apparatus with use of suitable coupling means, effectively prevent overheating with conjoint use of a bimetal, or can be adapted to operate a ventilating fan simultaneously with ignition when including a microswitch.

What is claimed is:

1. A safety device of the friction ratchet type operable on extinction of a gas flame comprising a valve operating rod connected to the valve stem of a stop valve mounted on a gas supply duct for a gas combustion apparatus and biased by a spring at all times in a direction to close the stop valve, a support bar secured to the main body of the device and formed with a hole extending therethrough, a holding bar pivoted at its one end to the main body and formed with a hole extending therethrough and arranged coaxially with the hole in the support bar in alignment therewith, the valve operating rod slidably extending through the holes and being supported by the bars, a heater wire extending outward from the main body to detect a gas flame, and holding bar turning means for inclining the holding bar by an elongation of the heater wire when the heater wire is heated by the gas flame to cause the holding bar to hold the valve operating rod in the open position of the stop valve, the holding bar turning means being operable to return the holding bar to its original position on contraction of the heater wire, thereby causing the valve operating rod to be released from the holding bar and to close the stop valve.

2. A safety device as defined in claim 1 wherein the holding bar is L-shaped and includes a projection on its pivoted end, the holding bar turning means comprising an auxiliary spring for biasing the holding bar toward its inclined position at all times and a lever positioned at a right angle to the holding bar and pivoted at its one point to the forward end of an arm extending from the main body, the lever having an upper bent end formed with a hole and a lower bent end formed with a cutout in engagement with the projection on the holding bar, the heater wire having an upper end engaged in the hole of the lever upper end and a lower end attached to an upper portion of the main body on one side thereof opposite to the arm.

3. A safety device as defined in claim 1 wherein the holding bar turning means comprises a sector lever pivotally supported at a position close to the pivoted portion of the holding bar and biased downward by a spring for preventing slackening of the heater wire, a projection secured to the holding bar for forming an arcuate wedge-shaped space between the sector lever and the projection, an auxiliary spring for biasing the holding bar toward its inclined position at all times, a rotatable member to be forced into the arcuate wedge-shaped space by a support spring attached to the under face of the projection, a stopper for preventing the holding bar from turning upward from a specified position, and a lever having the lower end of the heater wire attached to its one end and pivoted to a lower portion of the main body in parallel to the holding bar, the lever being in contact with the sector lever from below.

4. A safety device as defined in claim 3 wherein the stopper is an adjusting screw mounted on an upper portion of the main body for depressing the rotatable member when the rotatable member moves upward from a specified position to disconnect the sector lever from the projection on the holding bar.

5. A safety device as defined in claim 3 wherein the lever having the heater wire attached thereto is pivoted at its intermediate portion to the main body and provided at the other end thereof opposite to the heater wire carrying end with a projection for raising the holding bar to its original position when the heater wire breaks off.

6. A safety device as defined in claim 3 wherein the rotatable member is a roller.

7. A safety device as defined in claim 3 wherein the upper end of the heater wire is attached to the forward end of an arm extending from the main body, the wire upper end being attached to the arm end by a tension adjusting screw secured to the lever or the arm forward end.

8. A safety device as defined in claim 3 wherein the upper end of the heater wire is secured to the gas combustion apparatus, and the lower end of the heater wire is attached to the lever by a tension adjusting screw mounted on the lever.

9. A safety device as defined in claim 1 wherein the holding bar turning means comprises a lever extending in parallel to the holding bar and pivoted at its one end to one side of an upper portion of the main body, a movable plate pivoted to the center portion or to the other free end of the lever and biased downward by a spring for preventing slackening of the heater wire, the movable plate being vertically movable by the expansion and contraction of the heater wire, means for slidably holding the movable plate provided at the center portion or free end of the holding bar, and an auxiliary spring for biasing the holding bar toward its inclined position at all times, the lower end of the heater wire being attached to the lever inwardly of its pivoted portion.

10. A safety device as defined in claim 9 wherein the upper end of the heater wire is attached to the forward end of an arm extending from the main body, the wire upper end being attached to the arm end by a tension adjusting screw secured to the lever or the arm forward end.

11. A safety device as defined in claim 9 wherein the upper end of the heater wire is secured to the gas combustion apparatus, and the lower end of the heater wire is attached to the lever by a tension adjusting screw mounted on the lever.

12. A safety device as defined in claim 9 wherein the means for slidably holding the movable plate comprises a roller and a rotatable member disposed in a wedge-shaped cutout portion of the holding bar and adapted to nip the movable plate, the roller being rotatably supported by the cutout portion, the rotatable member being retained by a support spring in its pushed-in position between a tapered portion and the movable plate, the holding bar being prevented by a stopper from turning upward from a horizontal position.

13. A safety device as defined in claim 12 wherein the stopper is an adjusting screw mounted on an upper portion of the main body for depressing the rotatable member of the movable plate slidably holding means when the rotatable member moves upward from a specified position to disconnect the holding bar from the removable plate.

14. A safety device as defined in claim 12 wherein the rotatable member is a roller.

15. A safety device as defined in claim 9 wherein the means for slidably holding the movable plate comprises a hook pivoted to the free end of the holding bar and having a front end supported by a lower projection on the movable plate and a projection on its rear end, a projection provided on the holding bar and positioned slightly inwardly of the rear end projection on the hook, and a wedge member pivoted to the lever and positioned inwardly of its free end, the wedge member having a forward end positioned between the hook rear end projection and the projection on the holding bar.

16. A safety device as defined in claim 1 wherein the heater wire is a heat resistant steel alloy wire heat-treated at a high temperature of at least 1000° C.

17. A safety device as defined in claim 1 wherein the holding bar comprises a rectangular plate and a member L-shaped in cross section and screwed to the rectangular plate, the L-shaped member being formed with the hole extending therethrough for passing the valve operating rod.

18. A safety device as defined in claim 1 wherein the valve operating rod and the valve stem of the stop valve are integral and are incorporated in a stop valve of the normally closed type.

19. A safety device as defined in claim 1 wherein the valve operating rod and the valve stem of the stop valve are connected together by coupling means and are incorporated in a stop valve of the normally open type.

20. A safety device as defined in claim 19 wherein the coupling means comprises a flexible metal pipe and a multiplicity of balls filled in the metal pipe and having a diameter slightly smaller than the inside diameter of the metal pipe.

21. A safety device as defined in claim 19 wherein the coupling means is hydraulic coupling means.

22. A safety device as defined in claim 1 wherein the spring is provided between the support bar for the valve operating rod and the lower enlarged end of the valve operating rod.

23. A safety device as defined in claim 1 wherein a microswitch operable by the valve operating rod when the rod moves upward to open the stop valve is secured to the main body above the valve operating rod.

24. A safety device as defined in claim 1 wherein the main body is provided below the holding bar with a pusher rod movable by an overheating preventing bimetal disk or plate attached to a side portion of the gas combustion apparatus.

* * * * *